US006655528B2

(12) United States Patent
King

(10) Patent No.: US 6,655,528 B2
(45) Date of Patent: Dec. 2, 2003

(54) LAPTOP COMPUTER CARRYING CASE AND IMPACT ISOLATING INSERT

(75) Inventor: William L. King, Denver, CO (US)

(73) Assignee: Samsonite Corporation, Denver, CO (US)

( * ) Notice: Subject to any disclaimer, the term of this patent is extended or adjusted under 35 U.S.C. 154(b) by 49 days.

(21) Appl. No.: 10/091,635

(22) Filed: Mar. 5, 2002

(65) Prior Publication Data

US 2002/0125156 A1 Sep. 12, 2002

Related U.S. Application Data

(60) Provisional application No. 60/274,058, filed on Mar. 7, 2001.

(51) Int. Cl.[7] ..... B65D 85/38
(52) U.S. Cl. ..... 206/320; 206/583
(58) Field of Search ..... 206/320, 583, 206/586, 591, 592, 594; 190/124, 127

(56) References Cited

U.S. PATENT DOCUMENTS 5,217,119 A * 6/1993 Hollingsworth ..... 206/583
5,494,157 A * 2/1996 Golenz et al. ..... 206/320
5,524,754 A * 6/1996 Hollingsworth ..... 206/320
5,529,184 A * 6/1996 Sadow ..... 206/320
5,775,497 A * 7/1998 Krulik ..... 206/320
5,857,568 A * 1/1999 Speirs ..... 206/320
6,237,766 B1 * 5/2001 Hollingsworth ..... 206/320

* cited by examiner

*Primary Examiner*—David T. Fidei
(74) *Attorney, Agent, or Firm*—Gregory W. O'Connor

(57) ABSTRACT

Of the various carrying cases especially designed to isolate the contained laptop computer from impact forces, all are deficient in isolating the laptop computer from impacts from all directions, for example if the case containing the laptop computer were dropped on any side, edge or corner. The disclosed case provides a lightweight framed shock-absorbing insert to resist the impact and to channel much of the impact energy away from the laptop computer. This insert has two flat panels sandwiching the laptop computer. These panels flex in response to impact from any direction, while isolating the laptop computer from direct impact with the floor or the like during impact of the case with the floor. The panels are constrained from collapsing by bending out of the plane of the panel during most impacts. Constraining structures include a surounding frame between the outer edges flat panels, and surrounding textile constructions that cooperate to keep the flat panels parallel and generally flat during impacts.

3 Claims, 10 Drawing Sheets

LAPTOP COMPUTER CARRYING CASE AND IMPACT ISOLATING INSERT

This application claims the benefit of provisional application Ser. No. 60/274,058 filed Mar. 7, 2001.

BACKGROUND OF THE INVENTION

This invention relates to luggage cases particularly designed to carry and protect laptop computers, known as laptop computer carrying cases. Particularly, the disclosed inventions relate to improvements in impact isolation structures that lend themselves to both hardside and softside case constructions, and more specifically to enhanced systems for protecting laptop computers when being carried in such laptop carrying cases.

One popular form of laptop computer protection uses compressible foam blocks or strips, or sealed air bladders to cushion the laptop computer. An example of such a system is shown in U.S. Pat. No. 4,339,039. Such blocks, strips, or bladders are positioned typically around the narrow side surfaces of the laptop computer and nestle between the corresponding perimeter wall of the carrying case (usually called the "rail") and the computer. The carrying case structure absorbs some impact energy. The foam or bladder components positioned between the computer and the source of impact (the floor if the carrying case has been dropped) get squeezed, thus absorbing some of the energy of the impact and slowing the rate of deceleration that the laptop would otherwise experience.

In contrast with cases that use these compressible foam cushions or bladders to isolate laptop computers from direct impact, this inventive system uses one or most preferably two generally flat walls or panels flanking or parallel to a broad face of the laptop computer to help hold the laptop computer's edges and corners away from the rail during impact, and thus from direct impact with the rail, even when the case is dropped on a side or corner. Such panel-based isolation systems use a significant portion of the case itself to yield in response to the impact, thus absorbing more of a share of the energy of the impact. This leaves less of the impact energy for the computer itself to absorb.

Two types of panel systems represent the leading examples of such panel-based systems. The first is characterized by that shown in U.S. Pat. Nos. 5,524,754 and 5,217,119. These patents advocate the use of a sling of stretchy material hanging from the top portions of one or more vertical walls of a carrying case to suspend the laptop computer above the bottom rail of the case. On impact, the shock is taken by the stretchy sling and by the carrying case structure. The laptop computer, if the case has been dropped on its bottom, decelerates relatively slowly since the stretchy sling material continues to distend into the space allowed by the distance the laptop is suspended above the bottom of the case. This system works relatively well, at least if the carrying case is dropped in a vertical position, that is if the case impacts bottom first onto a horizontal surface. If the computer case were to fall on a side surface of the rail rather than the bottom, or tumble from a table top onto its top surface, the elastic sling would not isolate the laptop computer, and catastrophic damage to the computer would be more likely to occur.

A second panel system to which the instant invention is more closely akin is shown in U.S. Pat. No. 5,529,184 to Sadow, which patent, to the extent it is not inconsistent with this disclosure, is hereby incorporated by reference. Here, a laptop computer is strapped to the center of a drumhead-like panel comprising a membrane of generally non-stretching material tensioned like a drum skin on a peripheral frame made of a resilient, flexible material. Should the carrying case incorporating this inventive panel hit the floor at virtually any location around the periphery, the impact energy tends to be absorbed and retransmitted to the entire panel. The resulting distortion of the surrounding frame holds the laptop away from the impacted side during all but the most severe falls, thus helping to avoid direct contact with the floor. The panel and the rest of the carrying case absorb and dissipate much of the energy of impact.

This patent also discusses using two such panels; one on each side of the laptop computer intended to be protected from impact damage (see FIG. 3 of U.S. Pat. No. 5,529,184). Apparently, the computer is strapped to the center of one of the panels, with the other panel merely held to the first panel by straps 28 and 30. Both panels are coated with a layer of foam plastic sponge for extra shock absorption.

However, until the invention detailed below, this system has lacked a practical application. Also, the system disclosed for strapping the laptop computer to the center of one of the tensioned membranes was cumbersome to use, and the shock absorbing ability of one or both of the resilient frames was compromised since the frames tend to bend out of the plane of the panel, potentially permitting the computer to bottom out.

Accordingly, it is an object of this invention to provide a panel-based shock absorbing system for a laptop computer carrying case that is remarkably effective in protecting the laptop computer from impacts in many directions.

It is another object of the invention to provide a system using two panel-type shock-absorbing systems that stabilize the panels for improved impact energy absorption.

It is a further object of this invention to provide a light, impact absorbing and isolating system for a laptop computer carrying case having an overall rectangular shape which can protect the attached laptop computer from impact resulting from being dropped onto virtually any side or corner of the case.

SUMMARY OF THE INVENTION

Accordingly, disclosed is a carrying case for a laptop computer including a first main compartment for holding the laptop computer, the main compartment sized to receive a laptop computer and having a shock absorbing insert comprising a first flat panel extending across the main compartment having at least one inextensible layer, a resilient hoop constrained by the inextensible layer, an upstanding frame sized to surround the laptop computer, the frame firmly affixed to the inextensible layer, a second flat panel extending across the main compartment, whereby the frame and the panels restrain the laptop computer when the carrying case is dropped.

The shock absorbing insert comprises two, substantially similar flat panels, each in turn comprising a flat envelope of generally inextensible fabric with one or more hoops of resilient wire, and the frame comprises a pair of similar frame constructions each affixed to one of the two flat panels, the two flat panels hinged to one another along an edge whereby the laptop computer can be placed between the flat panels and surrounded by the frame constructions.

DETAILED DESCRIPTION OF THE PREFERRED EMBODIMENTS

The Carrying Case

Figure 1:
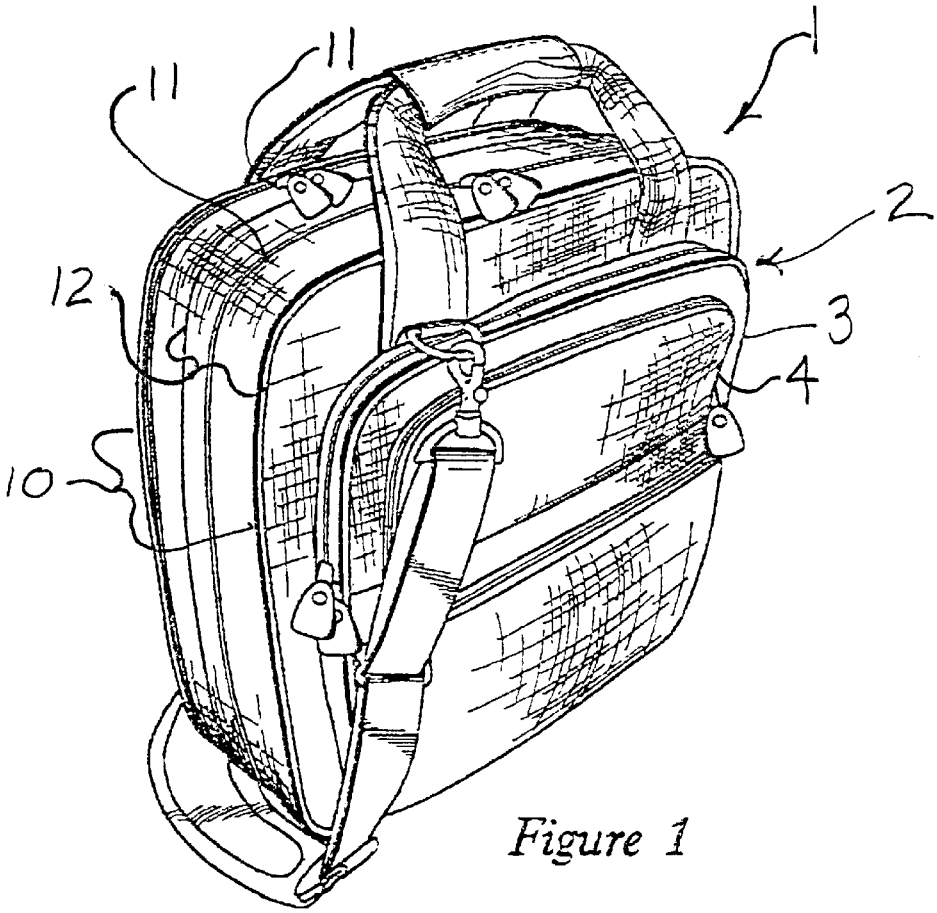
FIG. 1 shows a perspective view of a laptop computer carrying case embodying the disclosed invention.
Figure 2:
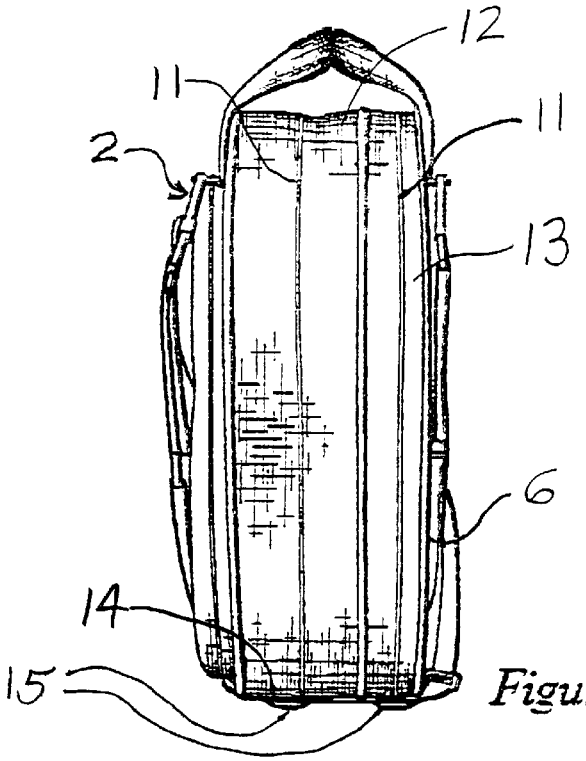
FIG. 2 is a side view of the case shown in FIG. 1 as seen from the side opposite of that shown in FIG. 1.
Figure 3:
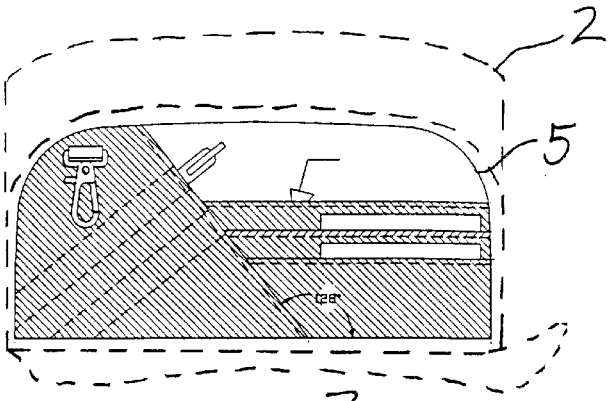
FIG. 3 shows an interior panel of this carrying case, with a portion of the rest of the case shown in dashed lines.
Figure 4:
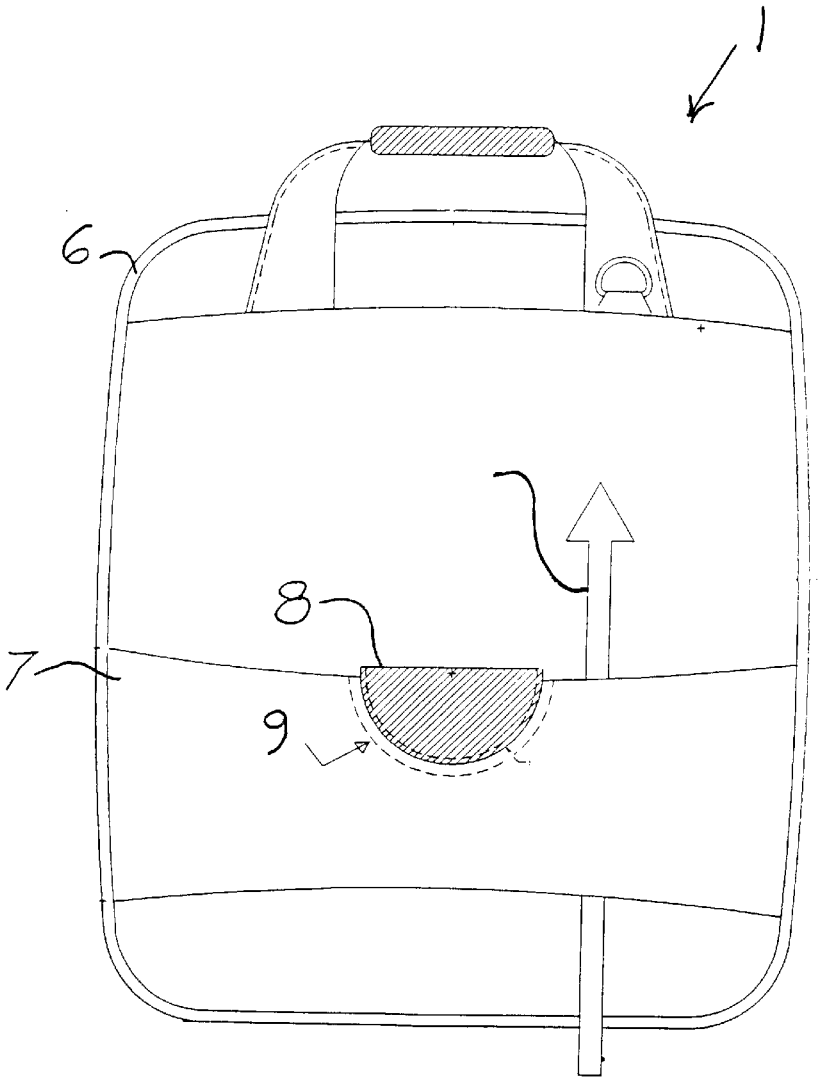
FIG. 4 shows a view of the back side of the carrying case.

Except as otherwise detailed below, and except as necessary to accommodate the inventive shock absorbing insert as will be detailed, the laptop computer carrying case 1 has a generally conventional construction. One relatively simple version of this carrying case 1 is shown in FIGS. 1 through 5. The front panel 2 of the case includes a pair of gusseted pockets 3 and 4. FIG. 3 shows the organizer panel 5 sewn into the interior of the upper pocket 3 of these two gusseted pockets. The back wall 6 of the case has a wide strap 7 sewn horizontally across the main body panel. The strap is sized to be slipped over the extendable handle used to steer upright luggage cases. A semicircular flap 8, preferably of leather, is affixed to the main body panel to project just above the upper edge of this wide strap. This flap can be selectively adhered to the strap 7 as shown, using conventional hook and loop fasteners 9 or mating snaps, to help affix the carrying case to the extended steering handle of the wheeled case for easy transport.

The rail portion 10 of the case has two slide fasteners 11 extending around three of the four sides of the rail so that two main compartments 12 and 13 open from the case fan-fashion from the base side 14 of the rail. The base side of the rail has elongated molded rubber glides 15 to support the case in the upright position shown. Within the first 12 of the two main compartments is a shock absorbing insert or module 20 that will be detailed below. The second 13 of the main compartments is a conventional portfolio type paper organizer and will not be otherwise detailed.

Figure 5:
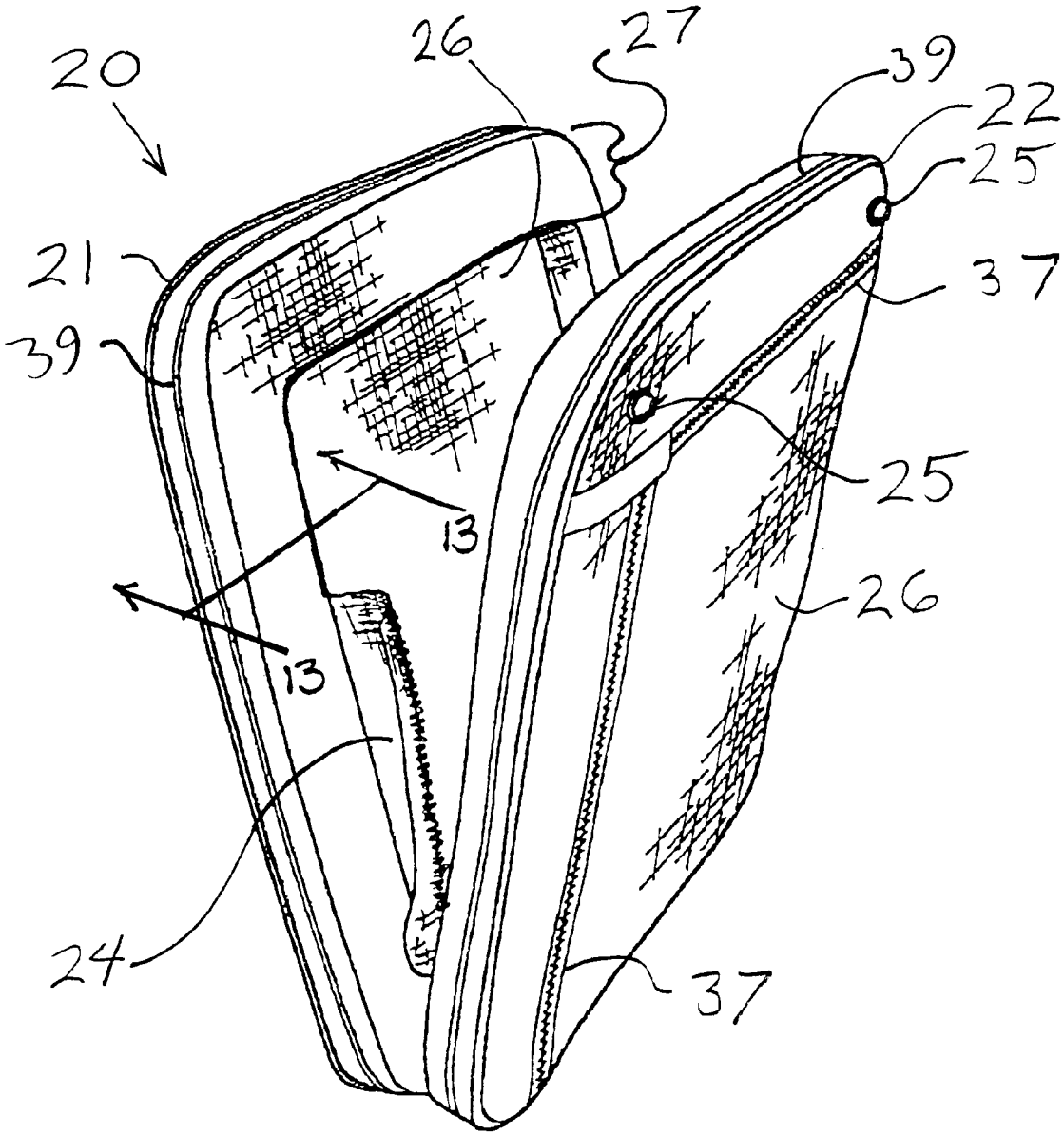
FIG. 5 is a perspective view of the shock-absorbing insert according to the subject invention.
Figure 6:
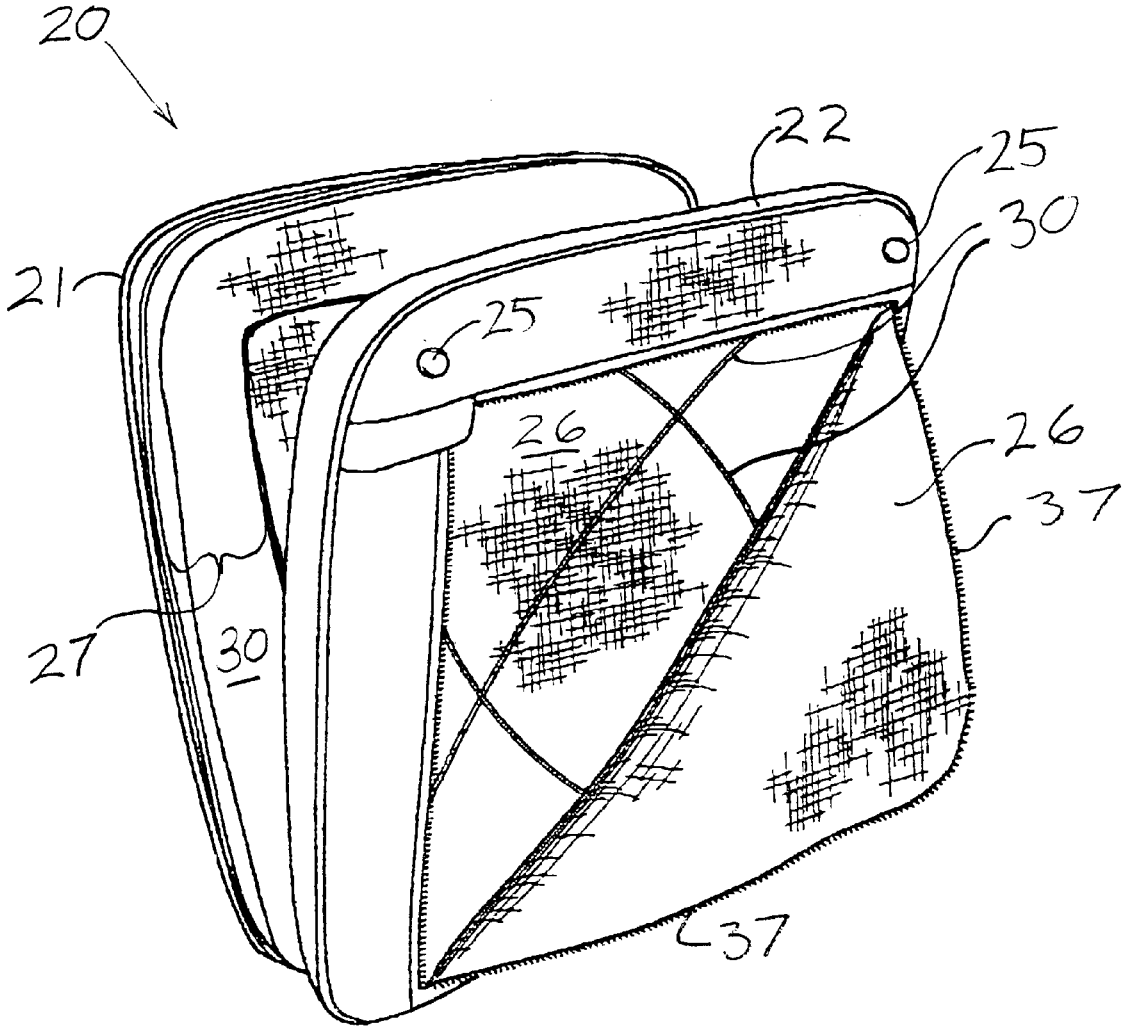
FIG. 6 is another view of the shock-absorbing insert.
Figure 11:
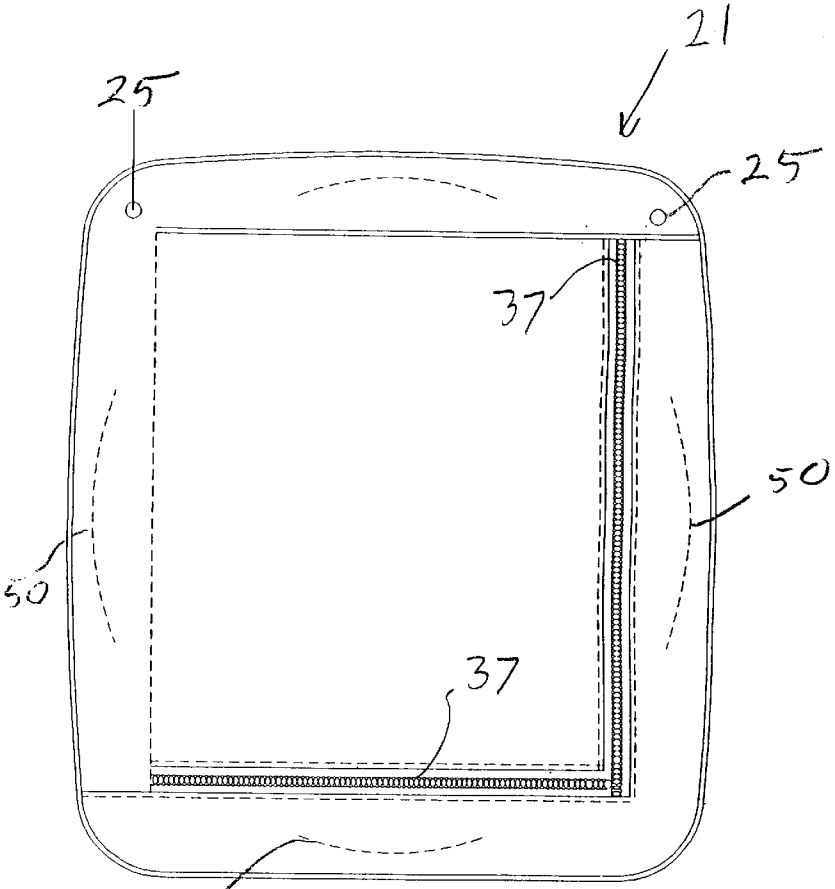
FIG. 11 is a back view of the subassembly.
Figure 7:
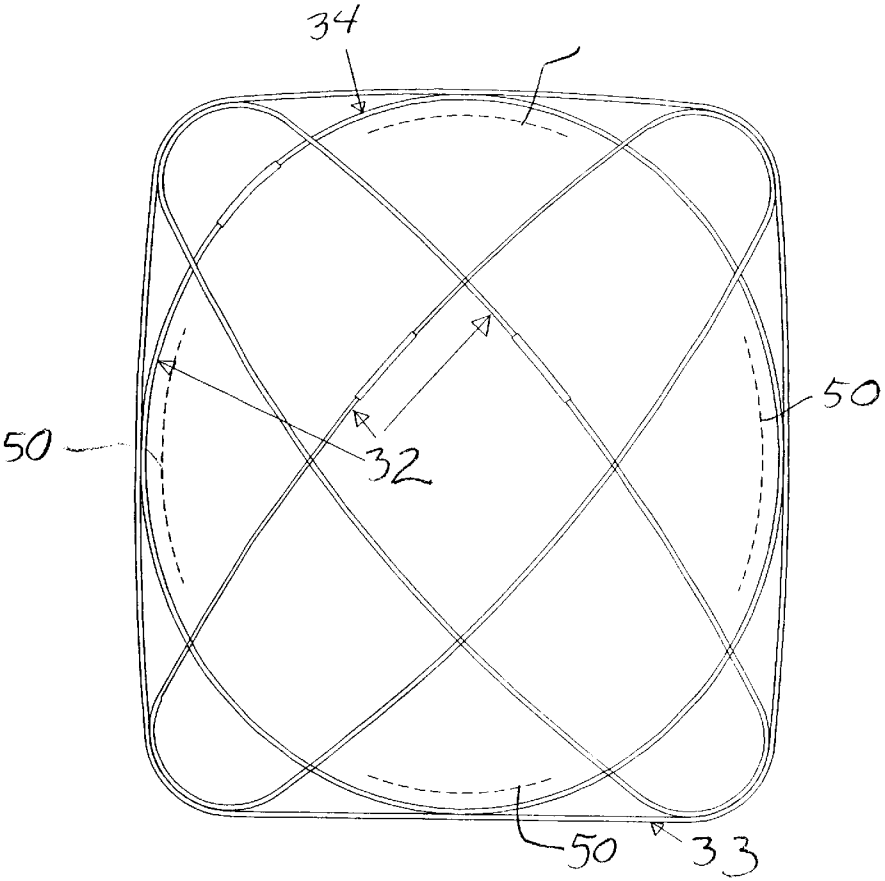
FIG. 7 is a plan view of the interior wire supports.
Figure 9:
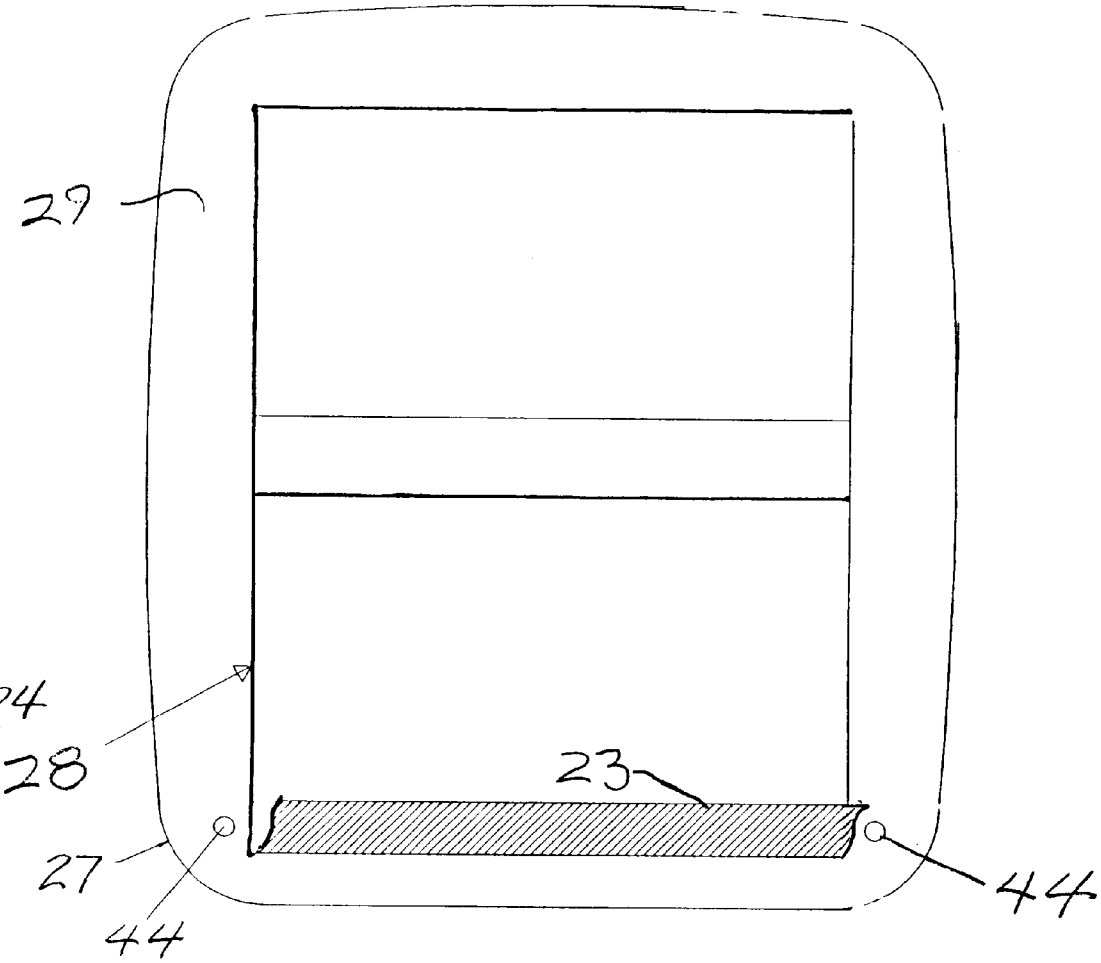
FIG. 9 is a front view of the subassembly shown in FIG. 8.

The first of the two main compartments contains the shock-absorbing insert 20 shown in FIG. 5, etc. The module consists of two substantially similar, generally mirror image subassemblies 21 and 22 that normally hinge together at their bottom edges using strips of hook and loop fastener tape 23 and snaps 44. This module is sized to just fit snugly within the rail portions 10 that extend around the first main compartment. Also, conventional snap fasteners 25 hold each subassembly to corresponding mating fasteners in its respective half of the first main compartment. Thus, when the main compartment of the carrying case is unzipped and opened, the module opens too to receive the laptop computer to be carried, or opens to permit access to the laptop computer secured within the module.

Each subassembly 21 and 22 in the pair of subassemblies making up the protective insert preferably consists of a textile wrapped tray-like structure. The broad face of each subassembly comprises a sewn, flat envelope 26 of tough, stretch resistant textile, such as nylon. Around each envelope's perimeter is a frame 27 comprising an inner frame of ABS extrusion 28, a surrounding frame 29 of high density foam plastic, all contained in a sewn annular jacket 30. This sewn annular jacket is firmly stitched at 38 and 44 around its inner and outer peripheries to the flat envelope 26. Within each flat envelope is a layer of conventional flexible foam sheet 31 and several, preferably four, resilient hoops 32 of tempered wire. Each hoop has a special shape and position within the flat envelope to resist collapse on impact and to otherwise absorb and dissipate impact energy.

The first 33 of these hoops is sewn into the extreme peripheral edge of the flat envelope. This hoop defines the shape of the envelope in the plane of the subassembly. It is felt this hoop functions according to U.S. Pat. No. 5,529,184 referenced above, tensioning and distorting the textile panels of the envelope during impact. The additional hoops also flex and move on impact. The first additional hoop 34 has an overall circular shape in plan, and is made of the same tempered steel wire as the other hoops. Note that it just fits within the envelope, pressing outward at the center of each generally straight edge of the envelope. The envelope is stitched 50 through near the portions of this circular hoop near where the circular hoop contacts the straight edges of the envelope. The remaining two hoops 35 and 36 are essentially identical to one another, both having an extremely flattened or oval circular shape. Each extends diagonally across the textile envelope between opposite corners thereof, crossing one another in the middle of the envelope. The circular hoop and these remaining two hoops are inserted into the envelope through the pair of slide fasteners 37 shown in FIG. 12.

The perimeter frame comprising the annular jacket 30 of textile and the foam and ABS plastic extrusion is firmly sewn to one side of the flat textile envelope. The foam portion 29 is preferably made from a frame of non-crosslinked polyethylene foam having a density of about 2 pounds per cubic foot, such as the type available commercially from Pednar Products Inc., 13130 Spring Street, Baldwin Park, Calif. 91706. The ABS plastic frame 28 is sized to engage the inner periphery of this foam portion, and may be made up of two or more L-shaped sections arranged end to end or overlapping to form a closed rectangle which, together with a matching frame on the other of the subassemblies, defines the laptop computer containing volume.

Figure 12:
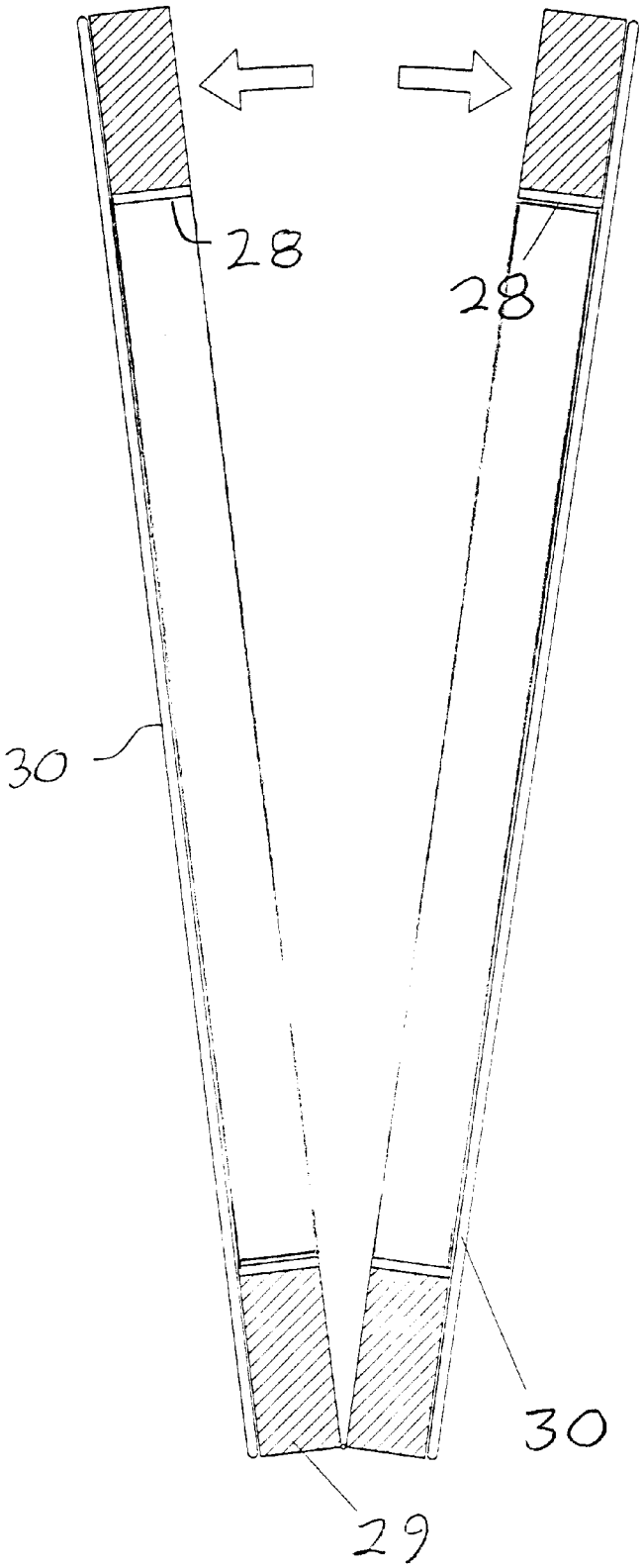
FIG. 12 shows a vertical cross-section through the skeletal portions of the insert.
Figure 13:
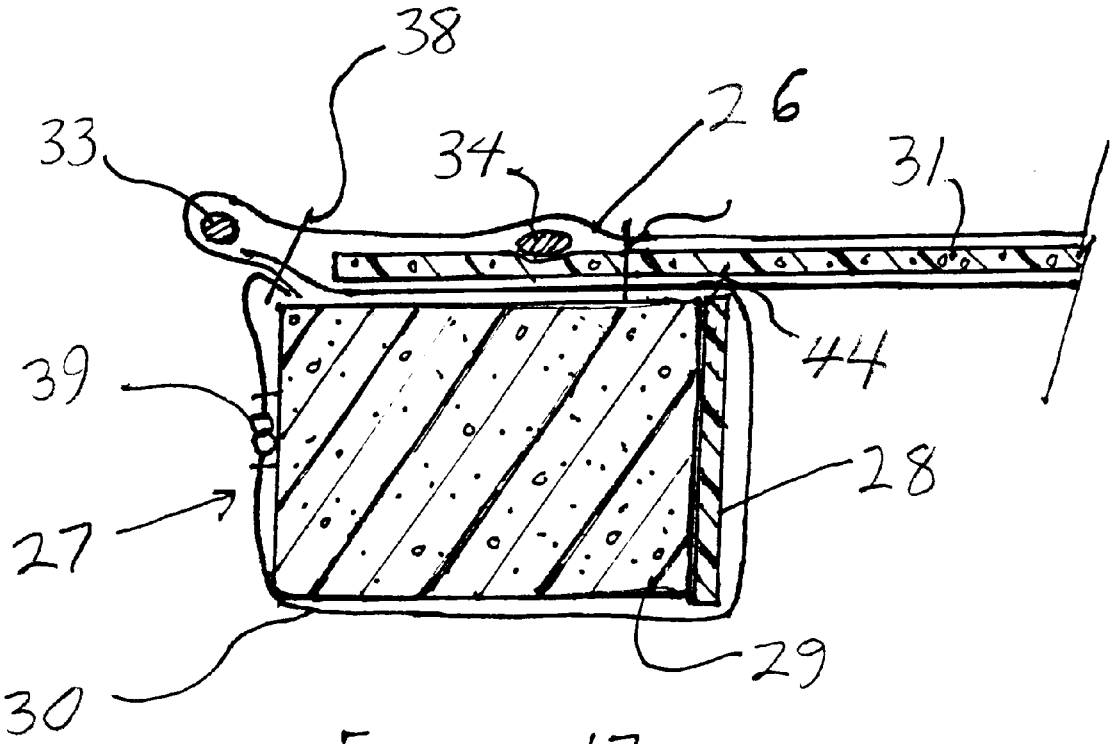
FIG. 13 is a partial cross-section taken through 13—13 of FIG. 5.

FIG. 12 shows a schematic, cross-sectional view of the skeletal or support portions of the two subassemblies. The assembly of four tempered wire hoops 30 is shown on edge, while the foam and ABS plastic frames are shown in cross-section. This figure shows the two skeletal subassemblies positioned relative to one another, as they would be in FIG. 5 for example—ready to receive a laptop computer prior to closing the slide fastener of the first main compartment of the case containing these subassemblies.

Figure 14:
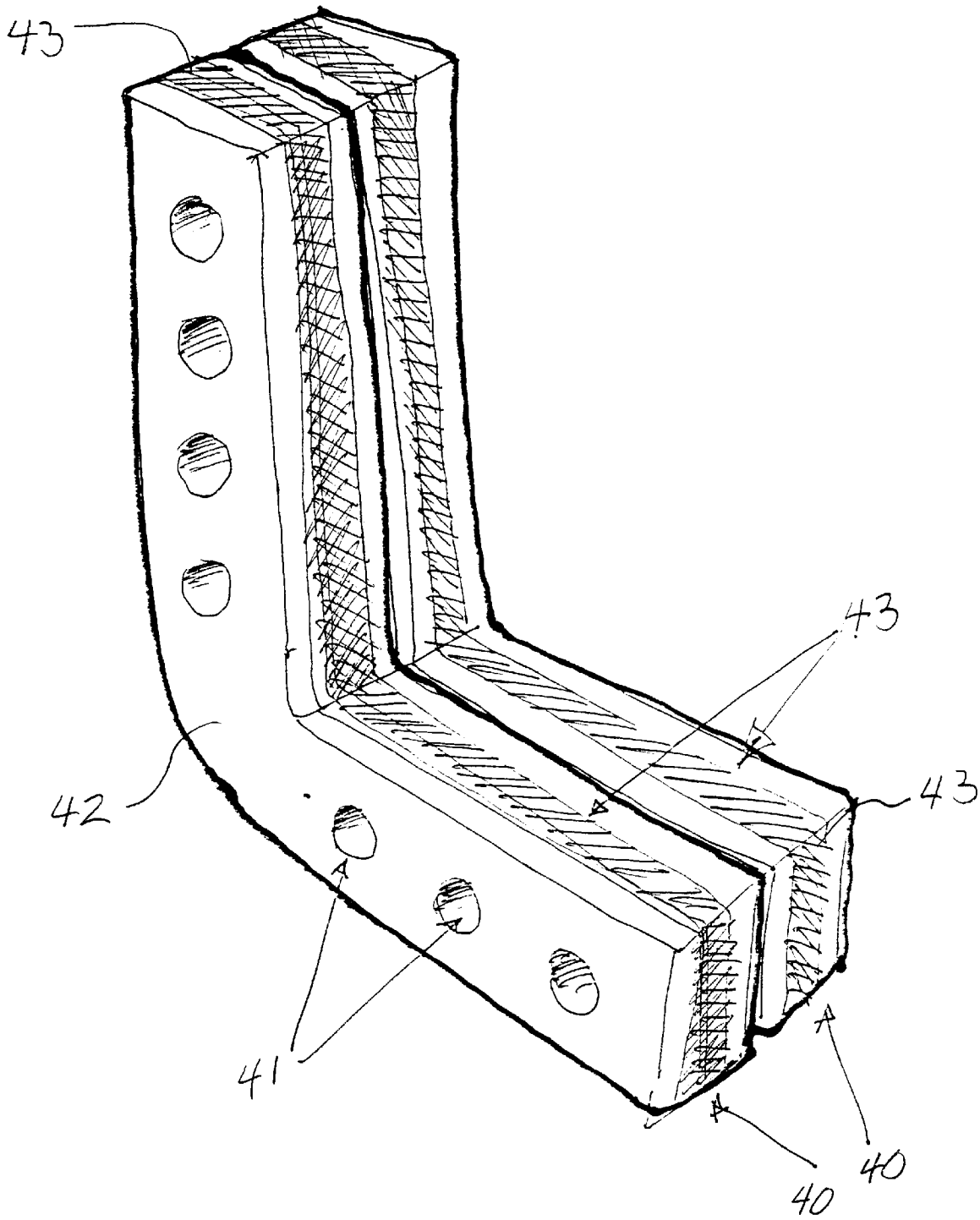
FIG. 14 is a perspective view of an alternate foam spacer construction.

FIG. 14 shows an alternate way to construct the foam frame portion. Here, instead of a continuous rectangular frame of the high-density polyethylene foam, each of four L-shaped foam shapes is die cut from a foam sheet. One or more holes 41 are cut through the foam sheets extending perpendicular to the plane of the frame. These holes reduce the amount of foam in the frame, thus reducing weight and increasing the compressibility of the foam selectively along the sides of the assembled frame. Note that, in this embodiment, there are no such holes at or near the corner portions 42 of the L-shaped components. This is to not decrease the stiffness or resistance to compression near these corners, while permitting a bit more compression in the straight portions of the frame. Note these L-shaped components include one or more layers of conventional, fiber reinforced strapping tape 43. The tape is adhered to the outward facing surfaces of the foam shapes as well as the inward facing surfaces adjacent to the ABS inner frame when assembled. While the scope of this invention should not be limited by any theory of operation, it is felt that this strapping tape reinforcement tends to resist the possibility of the ABS frame corners cutting through the foam corners. The tape, being quite resistant to stretching, also helps involve more of the foam in absorbing impact. When the laptop computer presses on only one arm of this L-shaped construction during impact, the strapping tape pulls downwardly on the other of the arms, causing foam in that arm to compress, hopefully slowing the laptop computer further and preferentially absorbing some more impact energy.

Figure 8:
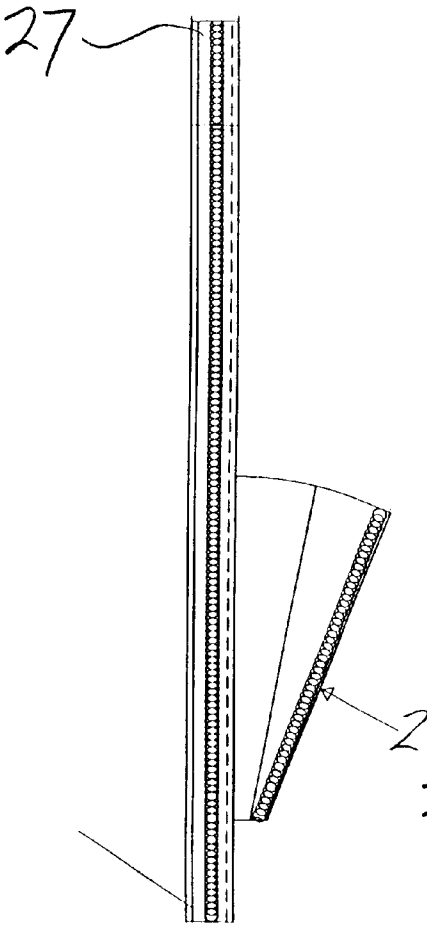
FIG. 8 is a side view of a subassembly of the shock-absorbing insert of FIGS. 6 and 7.
Figure 10:
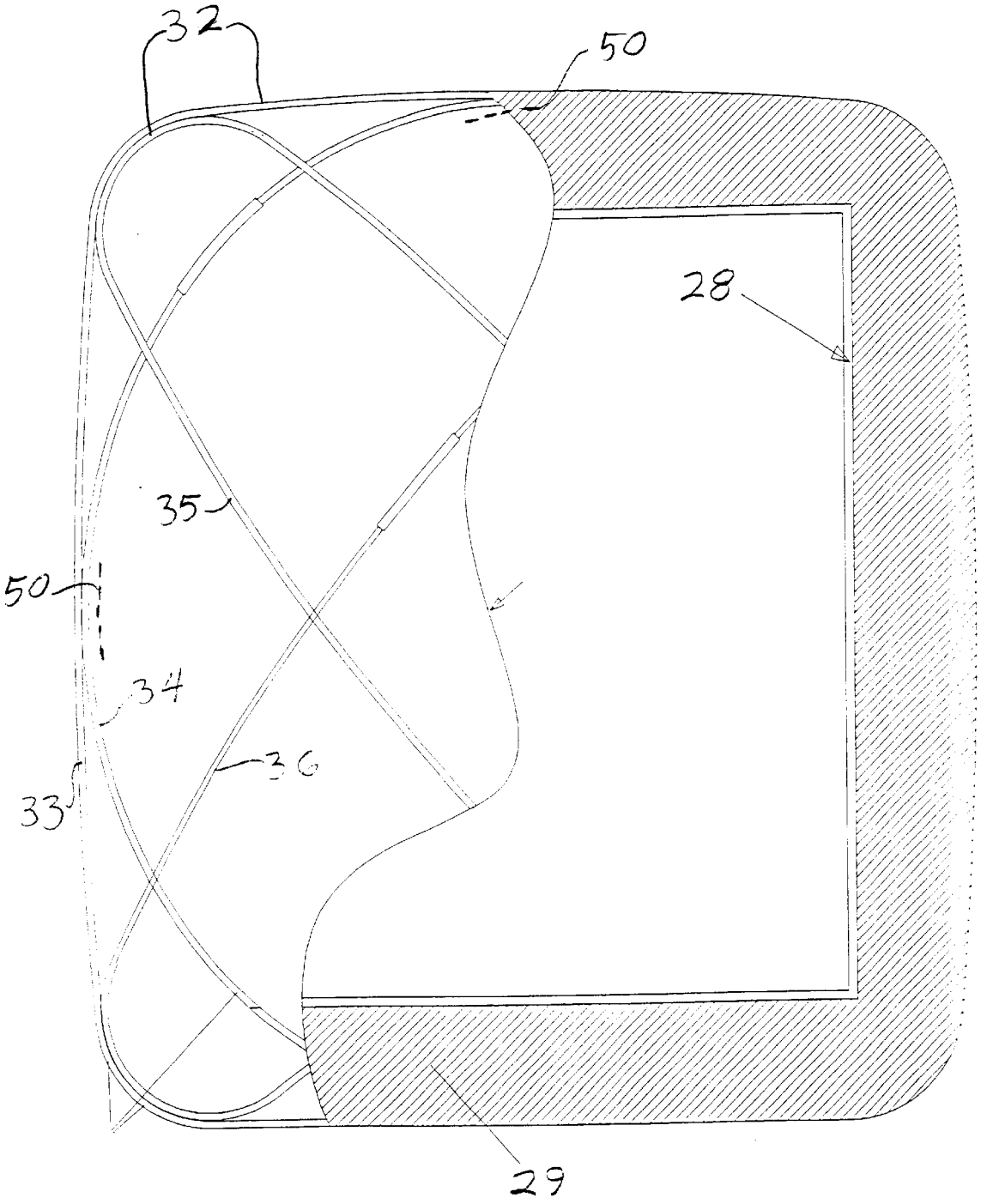
FIG. 10 is a cross-section and partially broken away view of the subassembly.

The protective insert is assembled as follows. First, the textile portions of each subassembly are sewn together using conventional sewing techniques. One of the subassemblies includes a strip of elastic webbing that extends across one of the panels for optionally capturing the laptop computer intended to be transported. The hook and loop fasteners are used to hinge the two subassemblies together along their bottom edges. Snap fasteners (shown on the insert) fasten to mating straps on the inside surfaces of the first main compartment. One of the subassemblies is provided with a triangular gusset 24 and a slide fastener along its free edge, one each along the vertical sides as shown in FIG. 8. The other of the subassemblies has a mating slide fastener along each of its vertical sides (not shown.)

Note various slide fastener closable openings 39 into the textile portions of the subassemblies are used extensively to permit this sewing assembly to take place first, while later the tempered steel wire hoops, ABS and foam frame portions can be stuffed into their respective textile jackets and envelopes through these slide fastener closable openings. The wire hoops are passed through the L-shaped opening on outwardly facing sides of the flat textile envelope (FIGS. 5 through 7 and 11). The first of the hoops is sewn into the outermost edge of the flat envelope, and the circular hoop is sewn to trap it at select locations as mentioned above. The ABS and foam frames are assembled into the perimeter textile jacket and captured by the perimeter slide fastener (FIGS. 5 and 8 for example). Then, the two subassemblies are attached at their lower edges by their mating hook and loop tapes. Finally, the assembled insert is pushed into its operative position within the first main compartment.

In operation, the user need only open the slide fastener into the first main compartment, and insert a laptop computer. Then this slide fastener is closed. This brings the two subassemblies into abutting, face-to-face contact. The ABS and foam frame structures come together to support the now trapped laptop computer, each contributing its structural and shock absorbing capabilities to protect the laptop computer from much of the impact forces associated with dropping the laptop computer containing carrying case from typical heights. In fact, testing has shown that on average, a typical laptop computer experiences an average peak of about 55 g's acceleration when the case is dropped from a height of about 40 inches above a typical hard floor surface. This is the average acceleration, whether it is dropped on any corner or any side of the inventive carrying case. This acceleration figure is well below that typically required to permanently damage the led screen or other relatively delicate component of a typically constructed laptop computer.

While the scope of the present invention should not be limited to any particular theory of operation, it should be instructive to speculate on such in order to provide the reader with a full understanding of this invention and its preferred embodiment. It is felt that the multiple tempered wire hoops assembled as disclosed absorb and dissipate quite a bit of the impact energy, while supporting the ABS frames that engage the laptop computer's edge surfaces. Modes of energy absorption include elastic deformation of the hoops themselves as well as the inextensible textile panels constraining these hoops. Frictional interengagement of the hoops with the thin foam panel also trapped within the flat textile envelope, as well as between the hoops, also likely contributes to preferentially absorbing and dissipating impact energy.

The surrounding foam frame also absorbs some energy while slowing the movement of the laptop computer during impact. Likely, the more important roll of the foam frame, however, is laterally stabilizing the flat, tempered wire supported panels during impact. The inventor has found that during impact, wire supported panels, if not properly constrained, collapsed erratically during impact, that is, such panels tended to bend out of plane. Such bending not only short circuited the ability of the panel to absorb and retransmit the impact energies to other portions of the carrying case, but also failed to support and slowly decelerate the laptop computer during impact. The foam frame tends to maintain distance between the hoop containing panels, especially at the corners. The snugly fitting main compartment keeps the hoop containing panels from splaying outwardly. Thus the hoop containing panels are trapped by the main compartment on the outside and the foam and ABS frame on the inside.

Alternative constructions to the preferred embodiment described in detail above are contemplated by this invention. For example, the insert described above could itself comprise a protective case if the abutting outermost edges of the textile frame were provided with mating perimeter slide fasteners to firmly close and hold the two subassemblies together around the laptop computer to be protected. Also, other means besides the foam frame to support the laptop computer while constraining the distortion of the flat panels during impact are made obvious by this disclosure. For example, air bags, both vented and pressurized, could work, as well as a gridwork of truss-like struts made of plastic or springy metal, could serve this dual roll as well.

What is claimed is:

1. A laptop computer carrying case for carrying a computer having side surfaces, a front face and a back face, a thickness dimension extending between the front face and the back face, a maximum dimension extending generally at right angles to the thickness dimension, and the side surfaces bounding the maximum dimension, the carrying case including a first main compartment for holding the laptop computer, the main compartment sized to receive a laptop computer and having a shock absorbing insert comprising a first flat panel extending across the main compartment substantially parallel with the maximum dimension of the laptop computer, the panel having at least one inextensible layer, a resilient hoop constrained by the inextensible layer, an upstanding frame sized to surround the laptop computer, the frame firmly affixed to the inextensible layer, a second flat panel extending across the main compartment firmly affixed to the upstanding frame, whereby the frame and the panels restrain the laptop computer when the carrying case is dropped.

2. A laptop computer carrying case as set forth in claim 1 wherein the shock absorbing insert comprises two, substantially similar flat panels, each in turn comprising a flat envelope of generally inextensible fabric with one or more hoops of resilient wire contained therein, and the frame comprises a pair of similar frame constructions each affixed to one of the two flat panels, the two flat panels hinged to one another along an edge whereby the laptop computer can be placed between the flat panels and surrounded by the frame constructions.

3. A laptop computer carrying case as set forth in claim 1 wherein the shock absorbing insert wherein the upstanding frame comprises a generally rigid rectangular frame of extruded plastic affixed to the inextensible material of the panel by a textile covering, the carrying case further comprises a compressible shock absorbing frame surrounding the upstanding frame.

* * * * *